US011039981B2

(12) United States Patent
Dwyer et al.

(10) Patent No.: US 11,039,981 B2
(45) Date of Patent: Jun. 22, 2021

(54) PORTABLE EYE WASHING STATION

(71) Applicants: James Dwyer, Baltimore, MD (US); Terry Callanan, Catonsville, MD (US)

(72) Inventors: James Dwyer, Baltimore, MD (US); Terry Callanan, Catonsville, MD (US)

( * ) Notice: Subject to any disclaimer, the term of this patent is extended or adjusted under 35 U.S.C. 154(b) by 0 days.

(21) Appl. No.: 16/437,862

(22) Filed: Jun. 11, 2019

(65) Prior Publication Data

US 2020/0390649 A1 Dec. 17, 2020

(51) Int. Cl.
*A61H 35/02* (2006.01)

(52) U.S. Cl.
CPC ..... *A61H 35/02* (2013.01)

(58) Field of Classification Search
CPC .... A61M 3/0279; A61M 3/0241; A61M 3/02; A61M 16/0666; A61H 35/02; A61F 9/0026
See application file for complete search history.

(56) References Cited

U.S. PATENT DOCUMENTS

D248,448 S 7/1978 McClure
4,798,599 A * 1/1989 Thomas ..... A61H 35/02 604/19
4,892,526 A * 1/1990 Reese ..... A61M 3/0241 604/290
6,168,577 B1 * 1/2001 Niederjohn ..... A61M 3/0279 604/23
6,432,078 B1 8/2002 Peyman
6,782,568 B2 8/2004 Novak
7,011,652 B1 * 3/2006 Berke ..... A61H 35/02 4/620
7,241,279 B1 7/2007 Wieczorek
7,481,223 B1 * 1/2009 Batistelli ..... A61M 16/0666 128/207.18
8,034,036 B2 10/2011 Osborne
8,205,279 B2 6/2012 Devinat
2007/0204398 A1 9/2007 Dubois
2012/0060845 A1 * 3/2012 McKinnon ..... A61M 16/0677 128/207.18
2019/0060114 A1 * 2/2019 Stinson ..... A61M 5/14

FOREIGN PATENT DOCUMENTS

DE 19523718 A1 * 1/1997 ..... A61H 35/02

* cited by examiner

*Primary Examiner* — Erin Deery

(57) ABSTRACT

A portable eye washing station includes a spike that can pierce a fluid source and the spike is hollow to pass fluid therethrough. A feed tube is fluidly coupled to the spike to receive the fluid from the spike. A fitting is fluidly coupled to the second end of the feed tube and the fitting has a pair of outputs to pass the fluid therethrough. A distribution tube is fluidly coupled to each of the outputs on the fitting such that the distribution tube forms a closed loop for wearing around a user's head. A cannula is fluidly coupled to the distribution tube to release the fluid and the cannula has a pair of outlets. Each of the outlets is aligned with a respective one of the user's eyes when the distribution tube is worn around the user's head. Thus, each of the outlets directs the fluid into the user's eyes for flushing the user's eyes.

9 Claims, 5 Drawing Sheets

PORTABLE EYE WASHING STATION

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to eye washing devices and more particularly pertains to a new eye washing device for flushing a user's eyes in a remote location.

BRIEF SUMMARY OF THE INVENTION

An embodiment of the disclosure meets the needs presented above by generally comprising a spike that can pierce a fluid source and the spike is hollow to pass fluid therethrough. A feed tube is fluidly coupled to the spike to receive the fluid from the spike. A fitting is fluidly coupled to the second end of the feed tube and the fitting has a pair of outputs to pass the fluid therethrough. A distribution tube is fluidly coupled to each of the outputs on the fitting such that the distribution tube forms a closed loop for wearing around a user's head. A cannula is fluidly coupled to the distribution tube. The cannula has a pair of outlets to pass the fluid therethrough. Each of the outlets is aligned with a respective one of the user's eyes when the distribution tube is worn around the user's head. Thus, each of outlets directs the fluid into the user's eyes for flushing the user's eyes.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
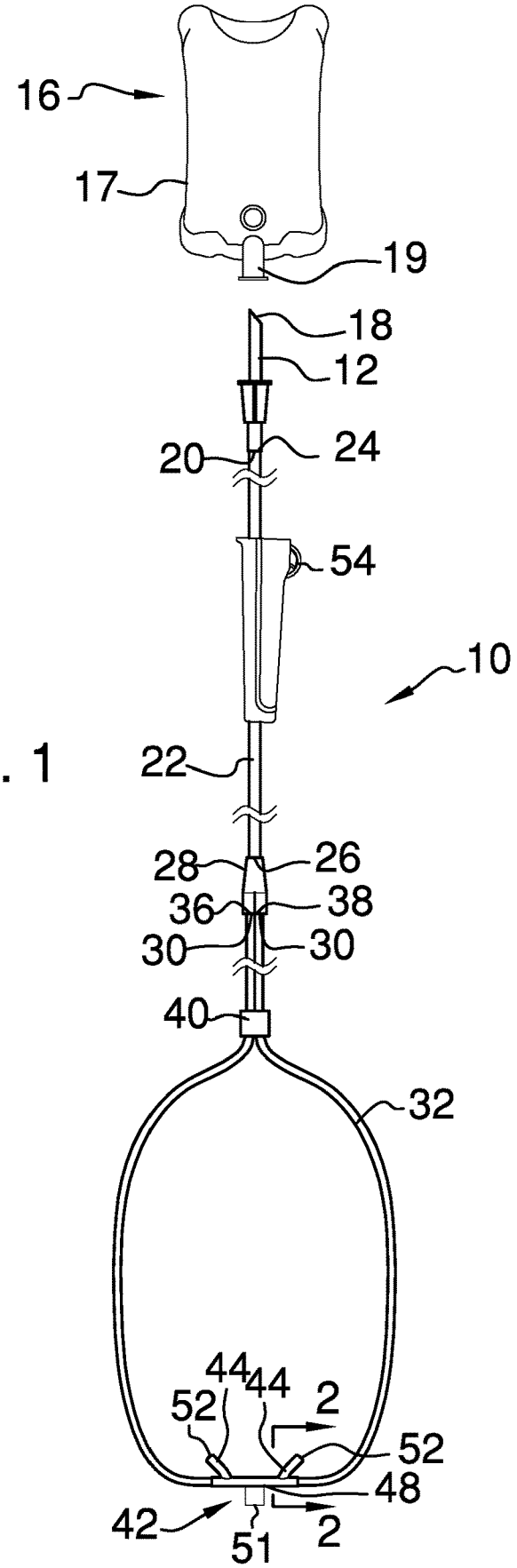
FIG. 1 is a front view of a portable eye washing station according to an embodiment of the disclosure.
Figure 2:
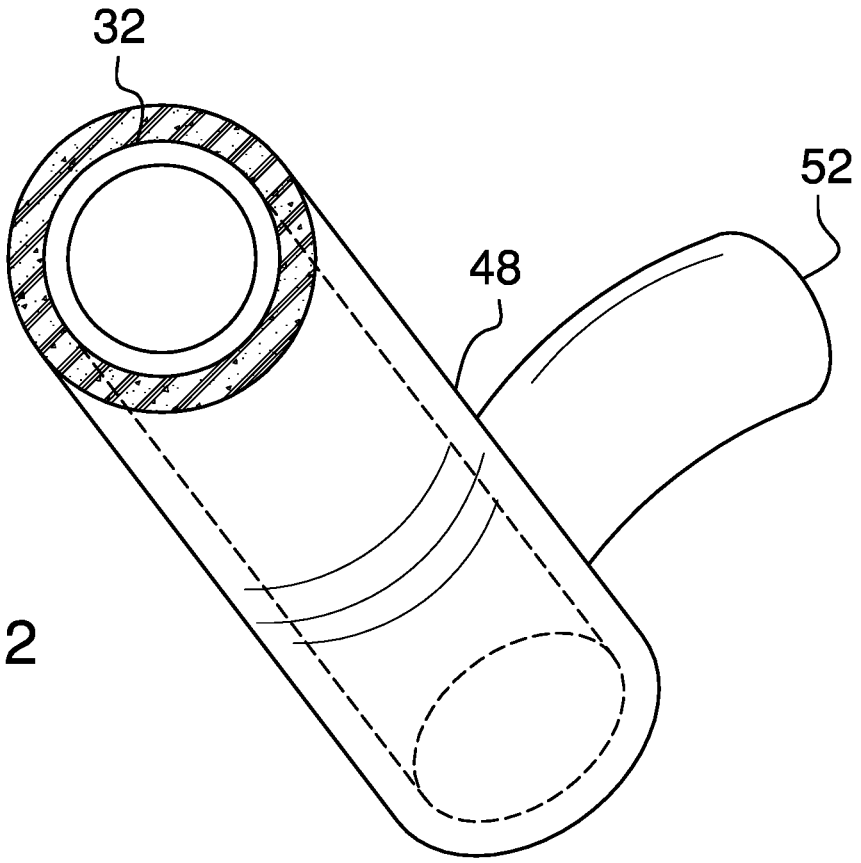
FIG. 2 is a cross sectional view taken along line 2-2 of FIG. 1 of an embodiment of the disclosure.
Figure 3:
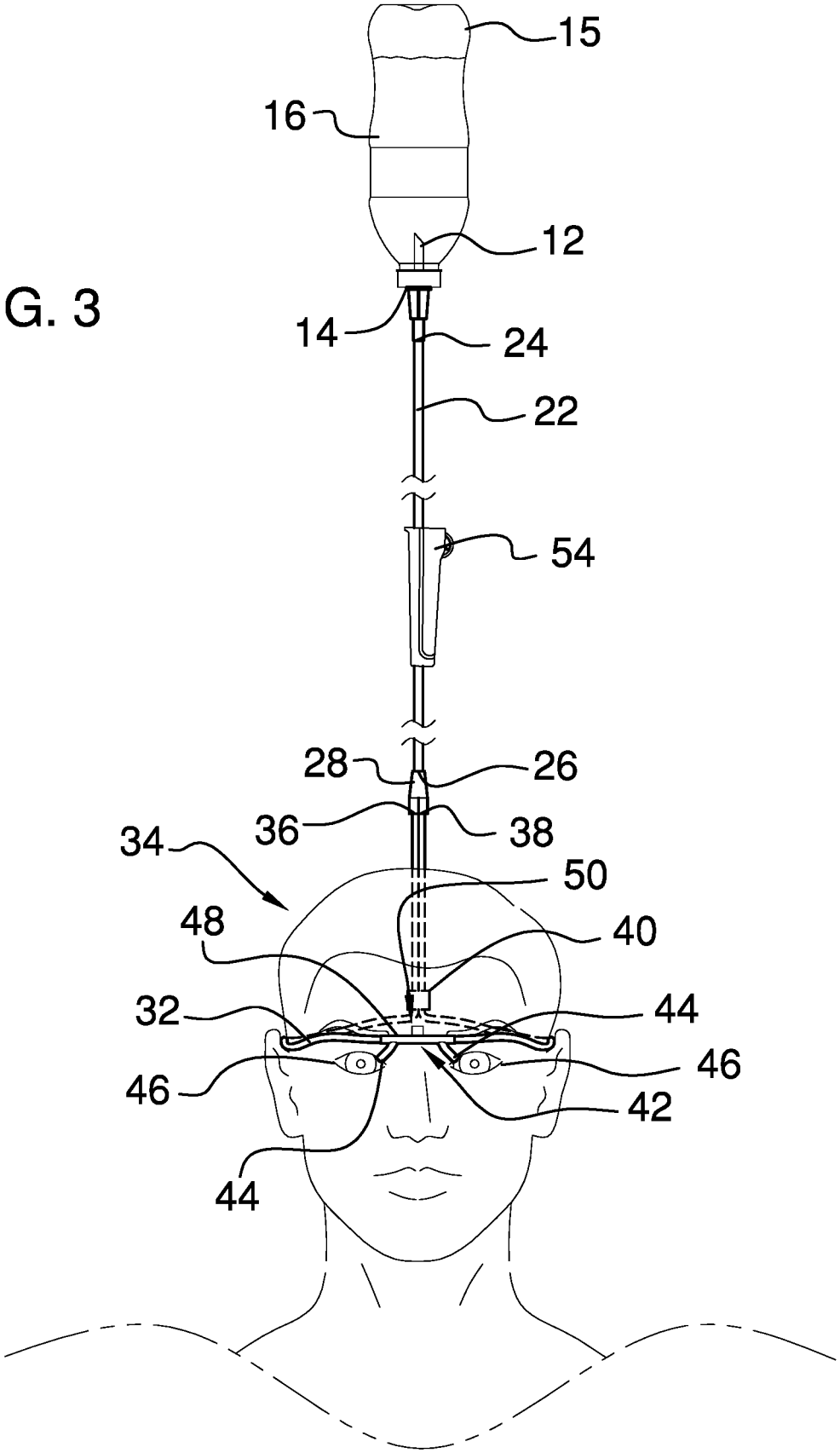
FIG. 3 is a front perspective in-use view of an embodiment of the disclosure.
Figure 4:
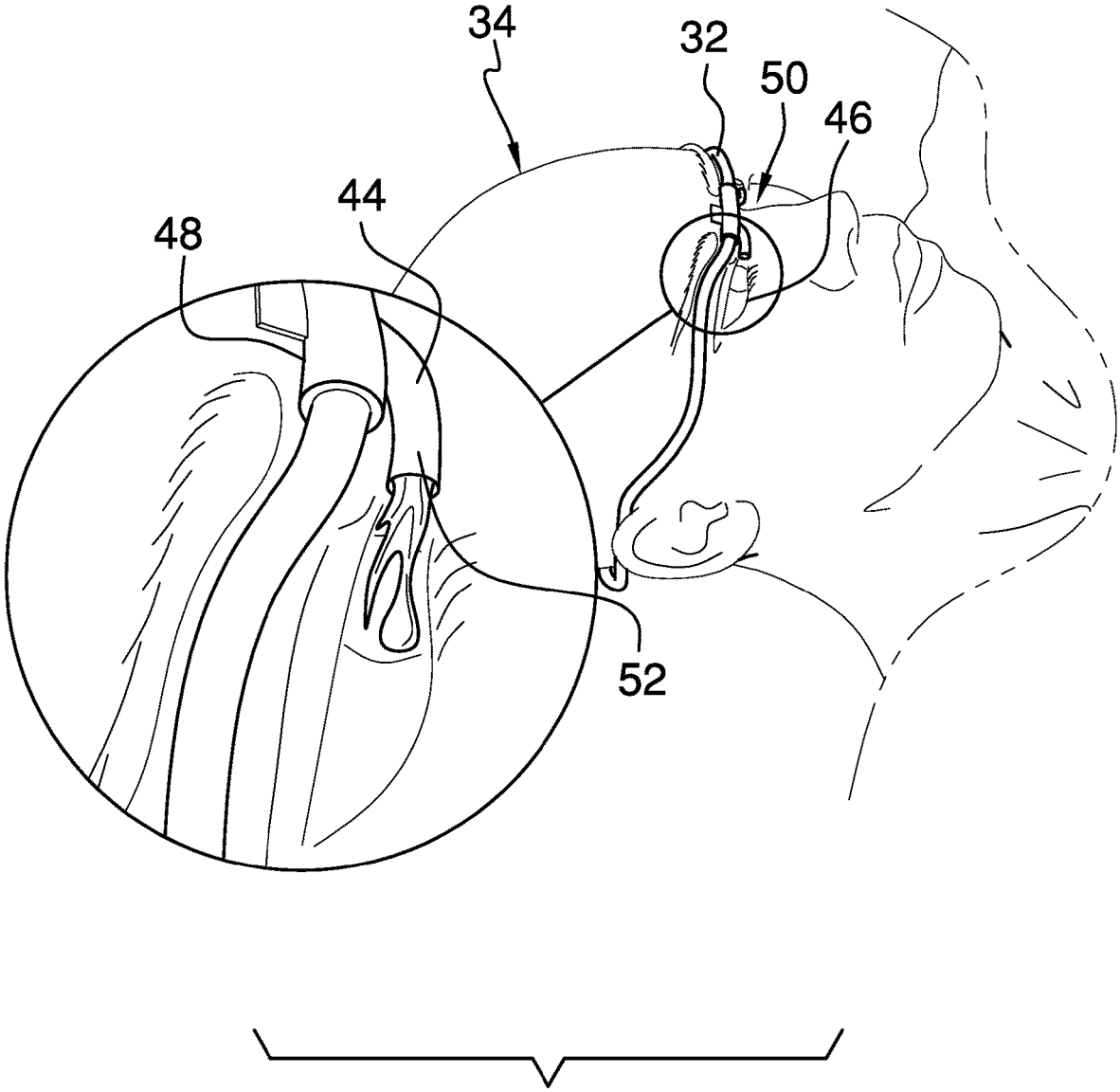
FIG. 4 is a perspective in-use view of an embodiment of the disclosure.

With reference now to the drawings, and in particular to FIGS. 1 through 5 thereof, a new eye washing device embodying the principles and concepts of an embodiment of the disclosure and generally designated by the reference numeral 10 will be described.

As best illustrated in FIGS. 1 through 5, the portable eye washing station 10 generally comprises a spike 12 for piercing a fluid source 16. The spike 12 is hollow to pass fluid therethrough similar to that of a hypodermic needle, and the spike 12 has a first end 18 and a second end 20. The first end 18 tapers to a point for piercing the fluid source 16. As is most clearly shown in FIG. 3, the fluid source 16 may be a bottle 15 of drinking water or any other commonly available water bottle 15. The first end of the spike can pierce a cap 14 of the water bottle 15. As is most clearly shown in FIG. 1, the fluid source 16 may be an intravenous bag of saline 17 that has an output 19. The first end 18 of the spike 12 can be inserted into the output 19 of the intravenous bag of saline 17. A feed tube 22 is fluidly coupled to the spike 12 to receive the fluid from the spike 12. The feed tube 22 has a first end 24 and a second end 26, and the first end 24 of the feed tube 22 is fluidly coupled to the second end 20 of the spike 12.

A fitting 28 is fluidly coupled to the second end 26 of the feed tube 22 and the fitting 28 has a pair of outputs 30 to pass the fluid therethrough. A distribution tube 32 is fluidly coupled to each of the outputs 30 on the fitting 28 such that the distribution tube 32 forms a closed loop. Thus, the distribution tube 32 can be worn around a user's head 34. The distribution tube 32 has a first end 36 and a second end 38, and each of the first 36 and second 38 ends of the distribution tube 32 is fluidly coupled to a respective one of the outputs 30 on the fitting 28. In this way the distribution tube 32 receives the fluid. A bolo 40 is slidably positioned around the distribution tube 32 for slidably adjusting a diameter of the closed loop formed by the distribution tube 32. In this way the distribution tube 32 can accommodate a variety of head sizes.

A cannula 42 is fluidly coupled to the distribution tube 32 thereby facilitating the cannula 42 to release the fluid. The cannula 42 has a pair of outlets 44 and each of the outlets 44 is aligned with a respective one of the user's eyes 46 when the distribution tube 32 is worn around the user's head 34. In this way each of outlets 44 can direct the fluid into the user's eyes 46 for flushing the user's eyes 46. The cannula 42 has a body 48 that is integrated into the distribution tube 32 such that the fluid flows through the body 48. Moreover, the body 48 is centrally positioned between the first 36 and second 38 ends of the distribution tube 32. Thus, the body 48 extends over a bridge of the user's nose 50 when the distribution tube 32 is worn around the user's head 34. A tab 51 may be coupled to the body 48 of the cannula 42 that serves to stabilized the cannula 42 on the user's head 34 when the distribution tube 32 is worn around the user's head 34.

Each of the outlets 44 is fluidly coupled to the body 48 and each of the outlets 44 angles outwardly from a center of the body 48. Thus, each of the outlets 44 extends toward a respective one of the user's eyes 46 when the body 48 extends over the bridge of the user's nose 50. Each of the outlets 44 has a distal end 52 with respect to the body 48 and the distal end 52 of each of the outlets 44 releases the fluid into the respective user's eye 46.

Figure 5:
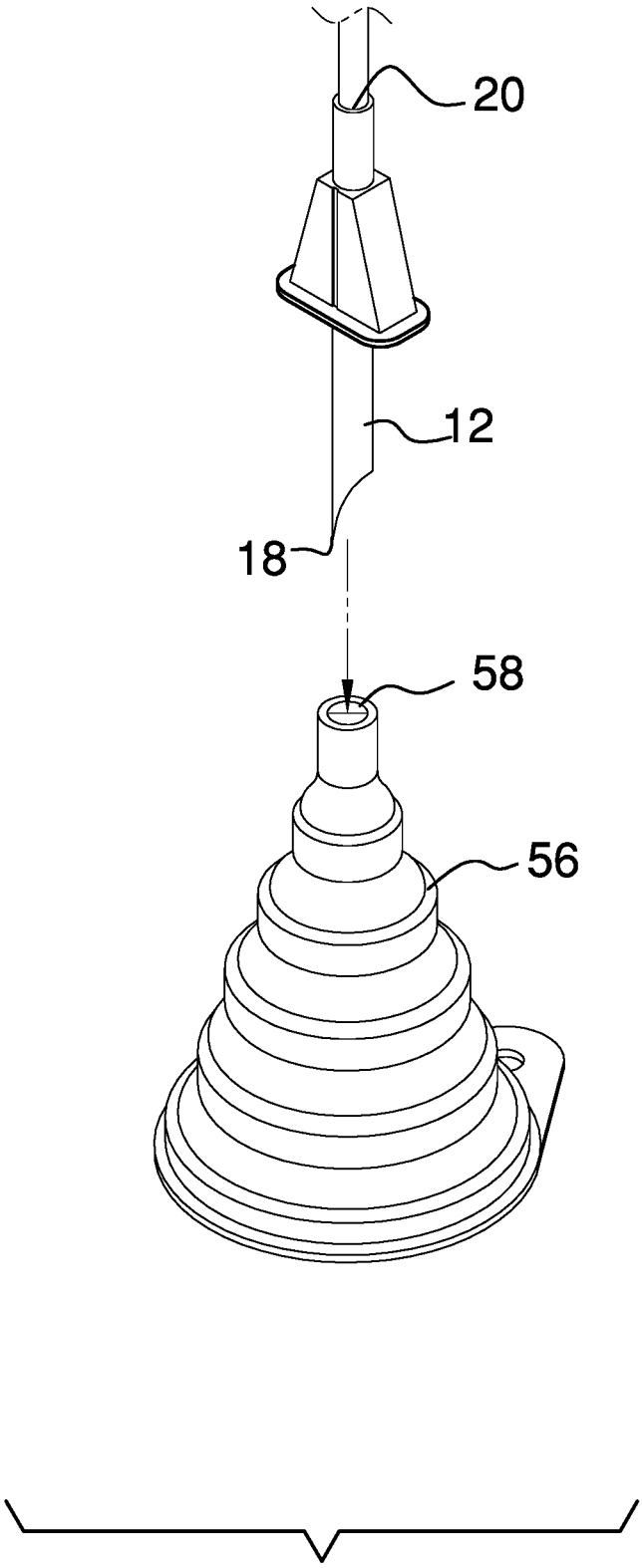
FIG. 5 is a perspective in-use view of a funnel of an embodiment of the disclosure.

A valve 54 is provided and the valve 54 is positioned around the feed tube 22. The valve 54 compresses the feed tube 22 when the valve 54 is closed to inhibit the fluid from flowing through the feed tube 22. The valve 54 disengages the feed tube 22 when the valve 54 is opened to allow the fluid to flow through the feed tube 22. The valve 54 may be a roller valve that is common to intravenous lines or the like. As shown in FIG. 5, a funnel 56 may be provided that can be coupled to a fluid source 16 that has no cap 14, such as a faucet or other uncontained fluid source. Thus, the spike 12 can be inserted into a narrow end 58 of the funnel 56 for receiving the fluid in the fluid source 16. The funnel 56 may be comprised of a resiliently compressible material, such as rubber or the like, and the narrow end 58 of the funnel 56 may form a fluid impermeable seal with the spike 12.

In use, the spike 12 is inserted into the fluid source 16 and the distribution tube 32 is worn around the user's head 34. The body 48 of the cannula 42 is positioned to extend over the bridge of the user's nose 50 thereby facilitating each of the outlets 44 to point toward the respective user's eye 46. The fluid source 16 is elevated over the user's head 34 and the valve 54 is opened. Thus, the fluid flows outwardly from the outlets 44 and into the user's eyes 46 to flush the user's eyes 46 when a chemical or foreign substance has been introduced into the user's eyes 46. Additionally, the user's eyes 46 can be flushed using any fluid source 16 in any location. In this way an individual can flush their eyes 46 when the individual is working or performing other duties in a remote location or the like.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A portable eye washing assembly being configured to be worn for flushing eyes, said assembly comprising:

a spike being configured to pierce a fluid source, said spike being hollow wherein said spike is configured to pass fluid therethrough;

a feed tube being fluidly coupled to said spike wherein said feed tube is configured to receive the fluid from said spike;

a fitting being fluidly coupled to said feed tube, said fitting having a pair of outputs wherein each of said outputs is configured to pass the fluid therethrough;

a distribution tube being fluidly coupled to each of said outputs on said fitting such that said distribution tube forms a closed loop wherein said distribution tube is configured to be worn around a user's head such that said distribution tube extends across a forehead of the user's head; and a cannula being fluidly coupled to said distribution tube wherein said cannula is configured to release the fluid, said cannula having a pair of outlets, each of said outlets being angled away from each other and curved such that said outlets are configured to extend downwardly from the user's forehead to being aligned with a respective one of the user's eyes when said distribution tube is worn around the user's head wherein each of the outlets is configured to direct the fluid away from the user's forehead and into the user's eyes for flushing the user's eyes.

2. The assembly according to claim 1, wherein:

said spike having a first end and a second end, said first end tapering to a point wherein said spike is configured to pierce the fluid source; and said feed tube has a first end and a second end, said first end of said feed tube being fluidly coupled to said second end of said spike.

3. The assembly according to claim 2, wherein said fluid source is one of a bottle and an IV bag.

4. The assembly according to claim 1, wherein said distribution tube has a first end and a second end, each of said first and second ends of said distribution tube being fluidly coupled to a respective one of said outputs on said fitting wherein said distribution tube is configured to receive the fluid.

5. The assembly according to claim 4, further comprising a bolo being slidably positioned around said distribution tube for slidably adjusting a diameter of the closed loop formed by said distribution tube.

6. The assembly according to claim 4, wherein said cannula has a body being integrated into said distribution tube wherein said body is configured to have the fluid flow therethrough, said body being centrally positioned between said first and second ends of said distribution tube wherein said body is configured to extend above a bridge of the user's nose when said distribution tube is worn around the user's head.

7. The assembly according to claim 6, wherein each of said outlets is fluidly coupled to said body, each of said outlets angling outwardly from a center of said body wherein each of said outlets is configured to extend toward a respective one of the user's eyes when said body extends above the bridge of the user's nose, each of said outlets having a distal end with respect to said body wherein said distal end of each of said outlets is configured to release the fluid into the respective user's eye.

8. The assembly according to claim 1, further comprising a valve being positioned around said feed tube, said valve compressing said feed tube when said valve is closed wherein said valve is configured to inhibit the fluid from flowing through said feed tube, said valve disengaging said feed tube when said valve is opened wherein said valve is configured to allow the fluid to flow through said feed tube.

9. A portable eye washing assembly being configured to be worn for flushing eyes, said assembly comprising:

a spike being configured to pierce a fluid source, said fluid source being configured to be one of a bottle and an IV bag, said spike being hollow wherein said spike is configured to pass fluid therethrough, said spike having a first end and a second end, said first end tapering to a point;

a feed tube being fluidly coupled to said spike wherein said feed tube is configured to receive the fluid from said spike, said feed tube having a first end and a second end, said first end of said feed tube being fluidly coupled to said second end of said spike;

a fitting being fluidly coupled to said second end of said feed tube, said fitting having a pair of outputs wherein each of said outputs is configured to pass the fluid therethrough;

a distribution tube being fluidly coupled to each of said outputs on said fitting such that said distribution tube forms a closed loop wherein said distribution tube is configured to be worn around a user's head such that said distribution tube extends across a forehead of the user's head, said distribution tube having a first end and a second end, each of said first and second ends of said distribution tube being fluidly coupled to a respective one of said outputs on said fitting wherein said distribution tube is configured to receive the fluid;

a bolo being slidably positioned around said distribution tube for slidably adjusting a diameter of the closed loop formed by said distribution tube; and a cannula being fluidly coupled to said distribution tube wherein said cannula is configured to release the fluid, said cannula having a pair of outlets, each of said outlets being angled away from each other and curved such that said outlets are configured to extend downwardly from the user's forehead to being aligned with a respective one of the user's eyes when said distribution tube is worn around the user's head wherein each of the outlets is configured to direct the fluid away from the user's forehead and into the user's eyes for flushing the user's eyes, said cannula having a body being integrated into said distribution tube wherein said body is configured to have the fluid flow therethrough, said body being centrally positioned between said first and second ends of said distribution tube wherein said body is configured to extend above a bridge of the user's nose when said distribution tube is worn around the user's head, each of said outlets being fluidly coupled to said body, each of said outlets angling outwardly from a center of said body wherein each of said outlets is configured to extend toward the respective one of the user's eyes when said body extends above the bridge of the user's nose, each of said outlets having a distal end with respect to said body wherein said distal end of each of said outlets is configured to release the fluid into the respective user's eye; and a valve being positioned around said feed tube, said valve compressing said feed tube when said valve is closed wherein said valve is configured to inhibit the fluid from flowing through said feed tube, said valve disengaging said feed tube when said valve is opened wherein said valve is configured to allow the fluid to flow through said feed tube.

* * * * *